US005109786A

United States Patent [19]

Hall

[11] Patent Number: 5,109,786

[45] Date of Patent: May 5, 1992

[54] SPINNAKER POLE

[76] Inventor: David R. Hall, Rte. 101 A - Box 909, Amherst, N.H. 03031

[21] Appl. No.: 633,241

[22] Filed: Dec. 21, 1990

[51] Int. Cl.[5] ..... B63H 9/10

[52] U.S. Cl. ..... 114/89; 114/102

[58] Field of Search ..... 114/89, 90, 97, 100, 114/101, 102, 109, 111, 221 R

[56] References Cited

U.S. PATENT DOCUMENTS 3,185,121 5/1965 Nilsen ..... 114/102 X 3,207,114 9/1965 Moseley ..... 114/102

FOREIGN PATENT DOCUMENTS 1205414 11/1965 Fed. Rep. of Germany ..... 114/89

2829043 1/1980 Fed. Rep. of Germany ..... 114/109

*Primary Examiner*—Sherman Basinger

*Attorney, Agent, or Firm*—Henry D. Pahl, Jr.

[57] ABSTRACT

The spinnaker pole disclosed herein is adapted to be attached at one end to the mast of a sailboat and provides, at the other end, an end fitting which is freely rotatable around the longitudinal axis of the pole and which provides, on opposite sides of that axis, first and second fairleads for freely passing guys to the clews of a spinnaker. The free rotation of the fitting allows a tensioned guy to align the respective fairlead thereby to avoid twisting of that guy and, since both guys pass through the fitting, detaching and re-attaching of guys to the pole during jibing is avoided.

6 Claims, 4 Drawing Sheets

SPINNAKER POLE

BACKGROUND OF THE INVENTION

The present invention relates to strut apparatus for holding out a headsail on a sailboat and more particularly to a spinnaker pole construction which facilitates jibing.

As is well understood by those skilled in the art, the jibing of a sailboat with spinnaker flying is one of the most difficult and demanding of maneuvers. Particularly in larger sailboats, each clew of the spinnaker has attached both a sheet and a guy. While sailing on a given course, the guy on the windward or pole side is active while, on the opposite side, the sheet is active. The distal end of the pole is normally attached or hooked onto the active guy by means of an end fitting providing an openable hook or fairlead.

In order to jibe a sailboat with spinnaker flying, it is necessary to essentially reverse or complement the active sheets and guys and to transfer the pole from the old windward side to the new windward side. There are basically two customary methods of jibing, end for end and dip pole. End for end jibing is essentially limited to smaller boats and the present invention is particularly intended for use with the dip pole method of jibing. The conventional dip pole method of jibing is described in some detail in an article by Scott Vogel published in the November 1989 issue of Sailing World magazine at page 36.

Basically, in dip pole jibing, the distal end of the spinnaker pole is detached from the previously active guy as the boat approaches a downwind state and the pole is then lowered so that it can pass beneath the headstay. As the pole passes the headstay, a crewman stationed in the bow of the boat places the previously slackened inactive guy in the end fitting of the pole and that guy is then tensioned to become the active guy as the pole is then raised on the new windward side. The chances for missing the hookup and for fouling or twisting a line are manifest and, as is understood, the crewman in the bow is in a precarious situation.

Among the several objects of the present invention may be noted the provision of novel strut or pole apparatus for supporting a headsail during downwind operation; the provision of novel spinnaker pole apparatus which facilitates jibing; the provision of such apparatus which facilitates dip pole jibing of a spinnaker sail; the provision of such apparatus which facilitates dip pole jibing of a spinnaker sail without requiring the use of a crewman at the bow during a jibe; the provision of such apparatus which facilitates changing of spinnakers; the provision of such apparatus which facilitates the jibing of a winged-out jib; the provision of such apparatus which is highly reliable; and the provision of such apparatus which is of relatively simple and inexpensive construction. Other objects and features will in part be apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

As discussed previously, the present invention relates generally to strut apparatus for holding out a headsail on a sailboat during downwind sailing and more particularly to a spinnaker pole construction which facilitates dip pole jibing. As also indicated previously, one end of a pole according to the present invention is provided for means for attaching that end of the pole to a sailboat mast. This attachment means may be entirely conventional and thus not described in detail herein. The other or distal end of the spinnaker pole is provided with a novel end fitting constructed in accordance with the invention.

Figure 1:
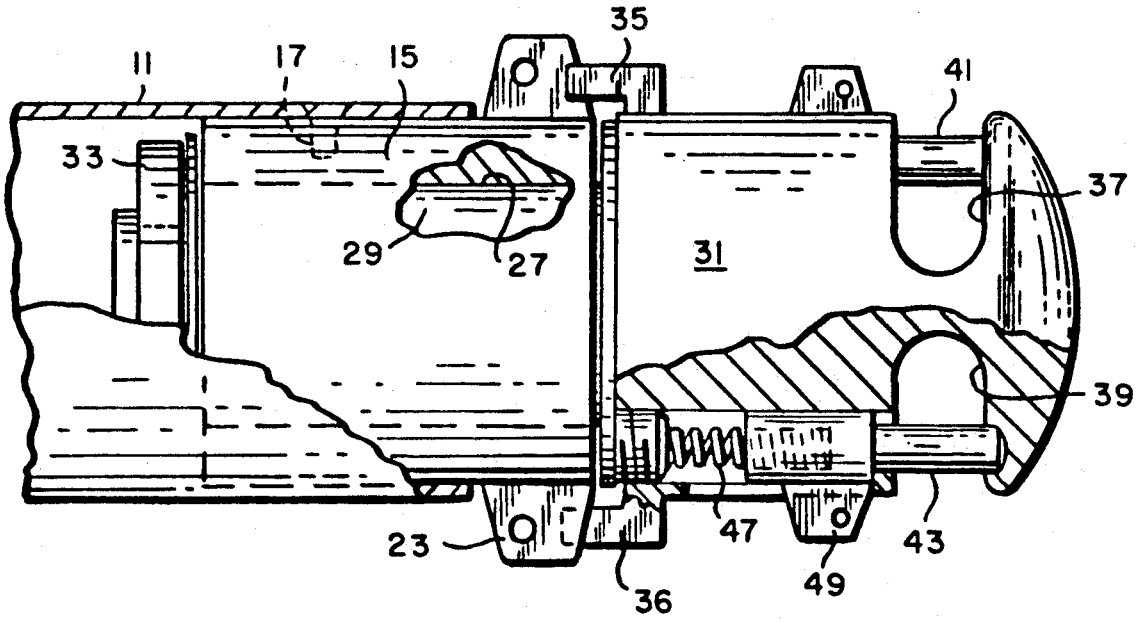
FIG. 1 is a side view, with parts broken away, of an illustrative embodiment of a spinnaker pole end fitting in accordance with the present invention.

With reference to FIG. 1, the distal end of a spinnaker pole is indicated generally by reference character 11. A socket structure, which is designated generally by reference character 15 and may, for example, be constructed of cast aluminum suitably machined, is secured in the distal end of pole 11 by means of screws 17.

The socket structure 15 is preferably provided with means for attaching a topping lift, such as the apertured tang designated by reference character 21, and means for attaching a foreguy, such as the apertured tang designated by reference character 23.

The socket structure 15 includes a central cylindrical aperture 27 which is aligned with the longitudinal pole axis and is adapted to receive a stem 29 extending from a rotatable end fitting designated generally by reference character 31. While the end piece fitting 31 is free to rotate around the longitudinal pole axis, it is prevented from falling out of the socket structure 15 by an endplate 33 which is pinned to the stem 29. Optionally, the rotation of the end fitting 31 may be limited to about 180 degrees by ears 35 and 36 which can engage the tangs 21 and 23. As an alternative to a separate and rotatable end fitting, the whole pole could rotate if an appropriate bearing were provided at its inner end.

The end fitting 31 is provided with a pair of notches 37 and 39 which are on opposite sides of the pole's longitudinal axis and which have smoothly rounded edges so that a line or rope such as a spinnaker guy can pass freely through the notch. Each of the notches 37 and 39 is normally closed by means of a respective spring-loaded pin 41 or 43 so as to constitute a normally closed but openable fairlead for a respective spinnaker guy. Each of the pins 41 and 43 is essentially similar to a single spinnaker jaw closing pin as has conventionally been provided hereinbefore. Likewise, each of the pins is provided with a tab 49 extending through a respective slot in the end fitting 31 so as to permit easy manual opening of the fairlead. Lanyards may be attached to the tabs in conventional fashion.

Figure 2:
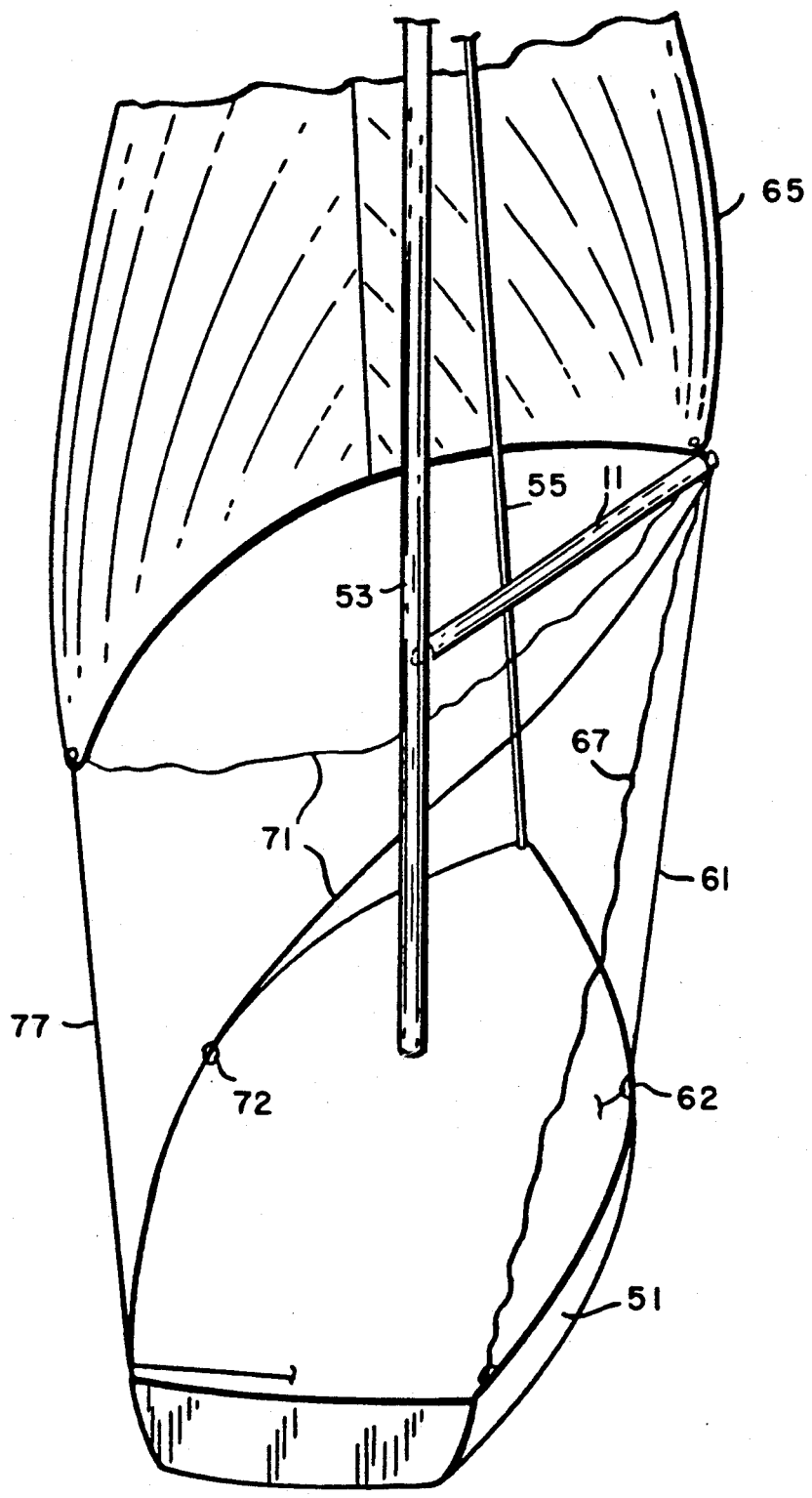
FIGS. 2, 3 and 4 illustrate successive stages in the conducting of a dip pole jibe using spinnaker pole apparatus in accordance with the present invention.

In use, the spinnaker pole is rigged with a guy from each clew of the spinnaker passing through a respective one of the fairlead notches 37 and 39. FIG. 2 illustrates a sloop sailboat so rigged and flying a spinnaker on the starboard tack. In conventional fashion, the sloop sailboat includes a hull 51, mast 53 and forestay 55. The mainsail, its boom and the other components of the boat have been omitted from the drawing so as to not obscure the spinnaker rigging described hereinafter.

Figure 5:
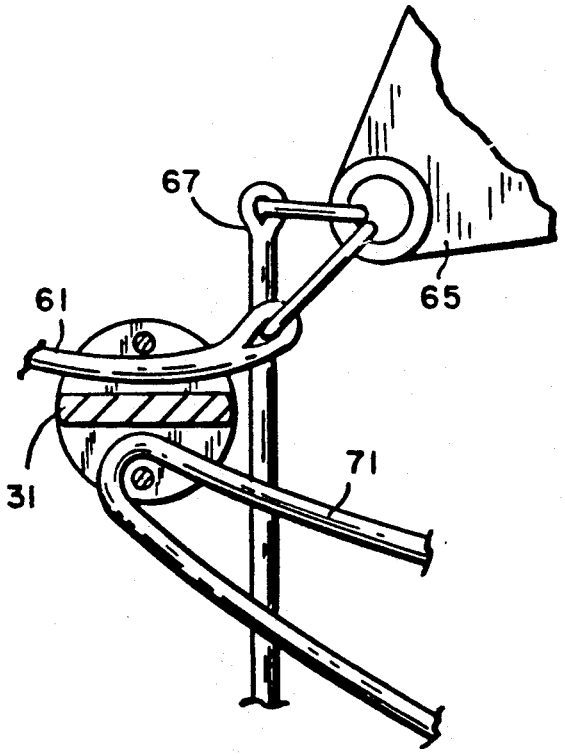
FIG. 5 is an end view with portions broken away of a spinnaker pole employing the fitting of FIG. 1, illustrating the orientation of the end fitting and arrangement of lines during operation on one tack.

On the starboard tack, the starboard spinnaker guy, designated by reference character 61, is active and passes up from its sheave 62, through a respective one of the fairleads, e.g. that designated by reference character 37, to the clew of a spinnaker. The spinnaker is designated generally by reference character 65. The starboard spinnaker sheet, designated by reference character 67, is slack and inactive as indicated in FIG. 2. As the end fitting 31 is freely rotatable around the longitudinal axis of the pole, the tension on the starboard guy 61 will cause the end fitting to self align so as to minimize twisting or bending of the guy as illustrated in FIG. 5.

On the other side, the port sheet 77 is under tension and controls the free clew of the spinnaker. The port guy 71, though inactive, passes from its sheave 72 up to the distal end of the pole and through the other of the fairleads, e.g. that designated by reference character 39, and thence slackly to the free clew of the spinnaker.

Figure 6:
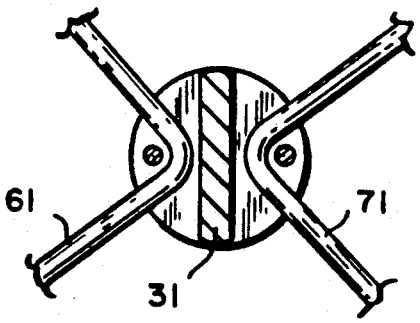
FIG. 6 is an end view with portions broken away of the spinnaker pole illustrating the intermediate orientation of the end fitting during a jibe.
Figure 3:
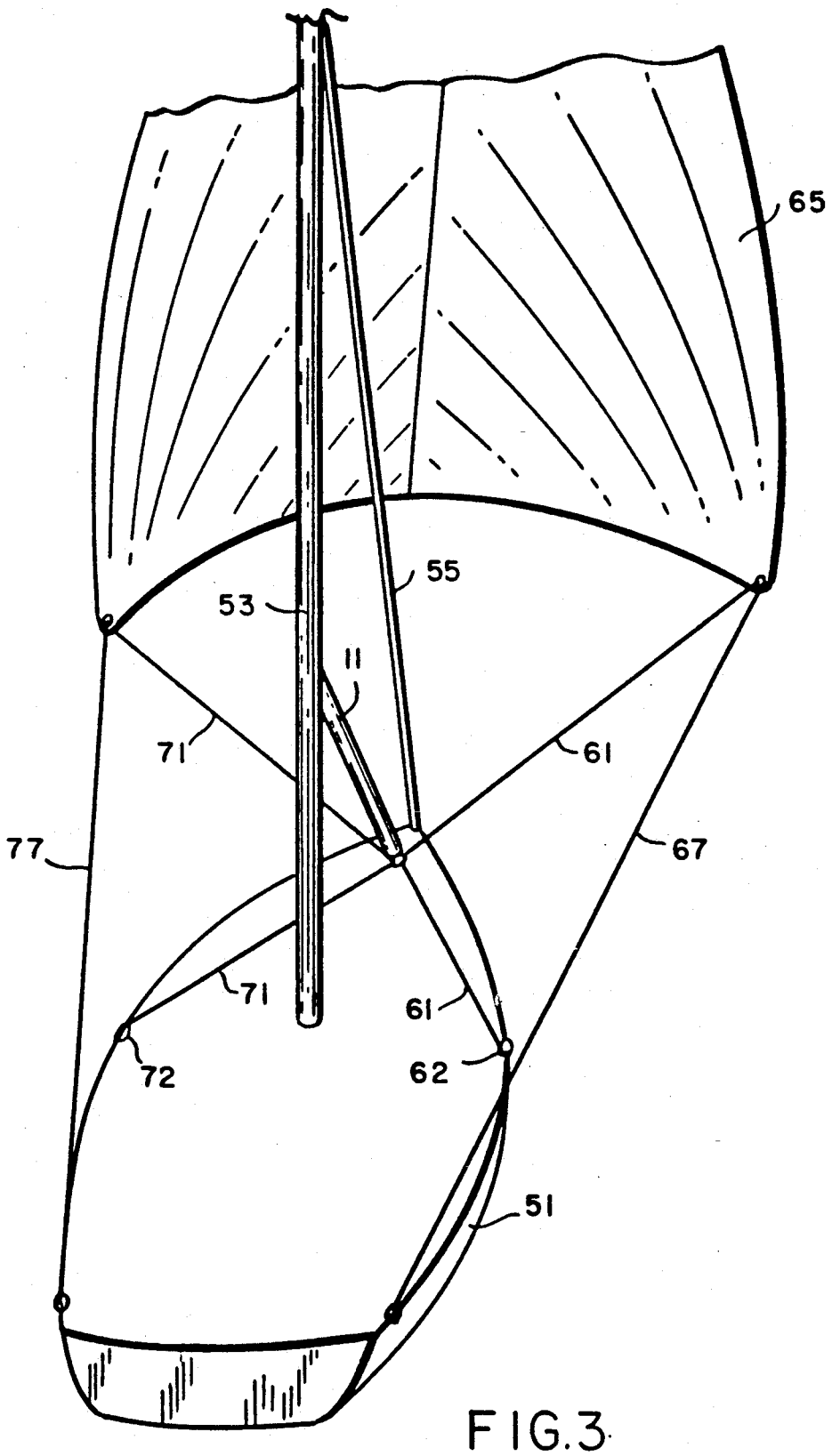

During jibing, as the boat approaches a directly downwind orientation, the spinnaker pole 11 is lowered, i.e. by means of the topping lift and fore guy in conventional manner though not shown, while the starboard guy is let off and the port guy 71 is taken in. Accordingly, the distal end of the spinnaker pole will pass through the fore triangle under the forestay 55 as illustrated in FIG. 3. Again, since the end fitting 31 is rotatable, the fairlead notches 37 and 39 will tend to re-orient themselves into a sort of average alignment with the sliding guys so as to minimize friction and binding. Typically, at mid point, the notches will extend essentially in a vertical direction as illustrated in FIG. 6.

Figure 4:
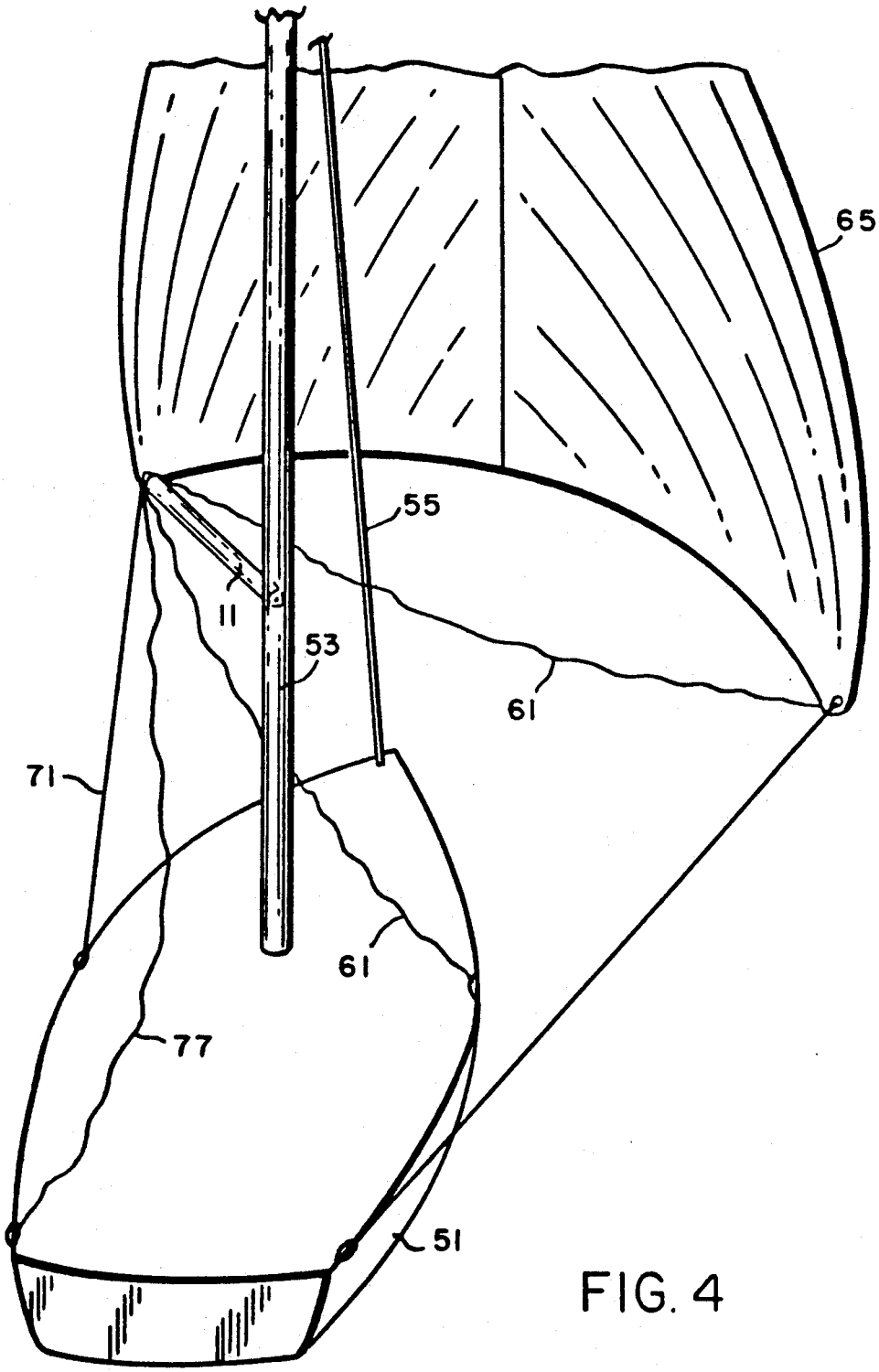

In completing the jibe, the port guy 71 will be tensioned as the pole is raised while the starboard guy is slacked so that an orientation is obtained as illustrated in FIG. 4, an orientation which is essentially the complement of that illustrated in FIG. 2.

As will be understood from the foregoing description, such a dip pole jibe can be performed with all crewman aft and with no one in the bow as would be required in conventional dip pole jibing. Further, since no lines need to be detached or re-attached, either to the spinnaker or to the spinnaker pole, the opportunities for fouling are greatly reduced.

In addition to facilitating dip pole jibing, the spinnaker pole of the present invention also facilitates the substitution of spinnakers on the fly so that the boat is never without a spinnaker, as is desirable during racing. This is sometimes referred to as a spinnaker peel. Prior to raising the new spinnaker, the inactive guy is merely transferred from the leeward clew of the active spinnaker to the windward clew of the new spinnaker and the tail end of the guy is brought aft to a substitute block or sheave. Then, once the new spinnaker is raised, that transferred guy can simply take up the load since it is already passing through a separate fairlead on the end of the spinnaker pole. This contrasts with the more usual situation in which a crewman must be hoisted to the distal end of the spinnaker pole, e.g. using a spare halyard, so as to allow him to rig a new windward guy for the new spinnaker. As is understood, this can be an extremely complex, difficult and dangerous procedure, particularly in heavy air. Once the new spinnaker is set, the lines can be re-rigged at leisure to permit a jibe if such is contemplated.

While the apparatus of the present invention is principally intended for use with spinnakers, it should be understood that it will also facilitate the use of a spinnaker pole in winging out a jib and permitting the jib to be jibed if the two jib sheets are run through the two fairleads of the end fitting. With a conventional spinnaker pole, the jibing of a winged out jib typically involves the disconnecting of one jib sheet from the pole and the connecting of the other if a wrapping of the sheet is to be avoided. An alternative method is to pass a fore guy through one of the fairleads at the distal end of the spinnaker pole and to then attach it to the clew of the jib. When the jib is switched from one tack to the other using its sheets, the free rotation of the end fitting allows the fore guy to assume a natural alignment.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

I claim:

1. Spinnaker pole apparatus comprising:

a spinnaker pole one end of which is adapted for pivotal attachment to a mast of a sailboat;

at the other end of said pole, bearing means for receiving a pole end fitting and permitting the end fitting to rotate freely around the pole's longitudinal axis;

journaled in said receiving means, an end fitting which provides on opposite sides of said axis first and second fairleads for passing guys to the clews of a spinnaker, the free rotation of the fitting allowing a tensioned guy to align the respective fairlead thereby to avoid twisting of that guy and to orient the other fairlead facing downwardly to facilitate free running of a slacked guy.

2. Apparatus as set forth in claim 1 wherein each of said fairleads is closed by a manually retractable pin.

3. Apparatus as set forth in claim 2 wherein said pins are provided with springs biasing them toward a closed position.

4. Spinnaker pole apparatus comprising:

a spinnaker pole one end of which is adapted for pivotal attachment to a mast of a sailboat;

at the other end of said pole, bearing means for receiving a pole end fitting and permitting the end fitting to rotate freely around the pole's longitudinal axis;

near said other end of said pole means on the top of said pole for attaching a topping lift and, on the bottom of said pole, means for attaching a foreguy;

journaled in said receiving means, an end fitting which provides, on opposite sides of said axis, first and second openable fairleads for passing guys to the clews of a spinnaker, the free rotation of the fitting allowing a tensioned guy to align the respective fairlead thereby to avoid twisting of that guy and to orient the other fairlead facing downwardly to facilitate free running of a slacked guy.

5. Apparatus as set forth in claim 4 wherein each of said fairleads is closed by a manually retractable pin.

6. Spinnaker pole apparatus for supporting a spinnaker sail on sailboat having at least one mast, said apparatus comprising:

a spinnaker pole one end of which is adapted for pivotal attachment to the sailboat mast; and at the other end of said pole, a fitting which is freely rotatable around the pole's longitudinal axis and provides, on opposite sides of said axis, first and second fairleads for freely passing guys to the clews of the spinnaker, the free rotation of the fitting allowing a tensioned guy to align the respective fairlead thereby to avoid twisting of that guy and to orient the other fairlead facing downwardly to facilitate free running of a slacked guy.

* * * * *